United States Patent [19]

Domnitz et al.

[11] 4,015,402

[45] Apr. 5, 1977

[54] APPARATUS AND METHOD FOR LOADING BLOCK-LIKE ARTICLES INTO A RECEPTACLE

[75] Inventors: David K. Domnitz, Taylors; Billy R. Osborne, Woodruff, both of S.C.

[73] Assignee: W. R. Grace & Co., Duncan, S.C.

[22] Filed: Feb. 19, 1976

[21] Appl. No.: 659,382

[52] U.S. Cl. ..... 53/29; 53/59 R; 53/187; 53/258; 53/385

[51] Int. Cl.[2] ..... B65B 43/36

[58] Field of Search ..... 53/29, 59 R, 189, 188, 53/187, 385, 258, 259

[56] References Cited

UNITED STATES PATENTS

| | | | |
|---|---|---|---|
| 3,228,171 | 1/1966 | Cory | 53/187 |
| 3,228,173 | 1/1966 | Reynolds | 53/385 |
| 3,490,195 | 1/1970 | Abramson | 53/189 X |
| 3,507,090 | 4/1970 | D'Angelo | 53/187 X |
| 3,766,708 | 10/1973 | Kubo et al. | 53/124 D |

*Primary Examiner*—Travis S. McGehee
*Attorney, Agent, or Firm*—John J. Toney; William D. Lee, Jr.; John B. Hardaway

[57] ABSTRACT

The invention relates to an apparatus and method for loading heavy, block-like articles such as blocks of cheese weighing 40 pounds or more into flexible receptacles such as thermoplastic bags. The apparatus comprises a reciprocally movable loading carriage and means for bringing an article to the carriage and positioning the article thereon. After the article is positioned on the carriage the carriage moves forward towards a wicketed or taped bag whose mouth is held open by a stream of air. Spreader means are provided on the movable carriage to stretch the bag mouth sufficiently wide so that a block of cheese may be inserted deep into the bag without contacting the mouth of the bag thereby preventing the deposit of grease from the cheese around the bag mouth which would interfere with a heat seal closure of the bag. Pusher means on the carriage push the article through the spreaders into the bag and the force of the article striking the bottom of the bag will sever it from the tape or wicket holding means and deliver the filled bag to a conveyor where it travels to a vacuumizing and heat sealing station.

11 Claims, 11 Drawing Figures

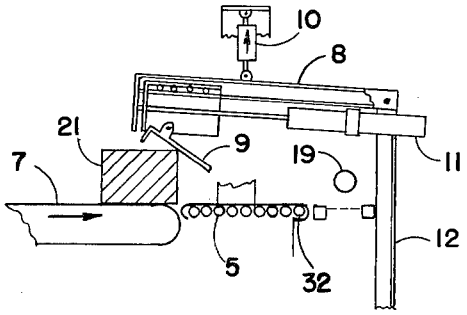
FIG. 5a
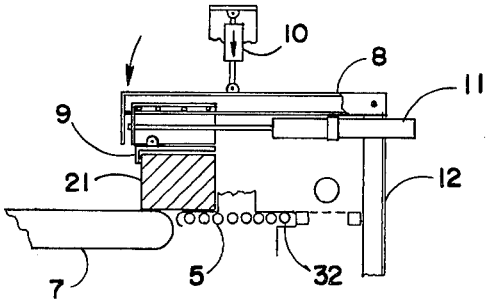
FIG. 5b
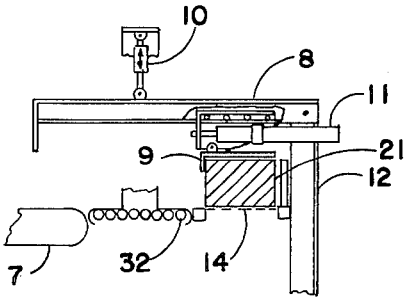
FIG. 5c
FIG. 5

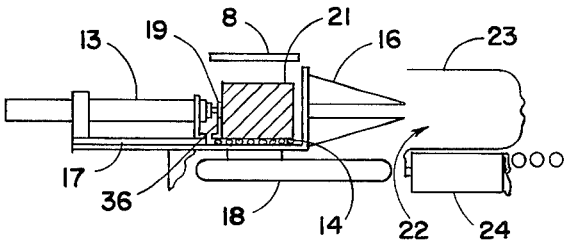
FIG. 6a
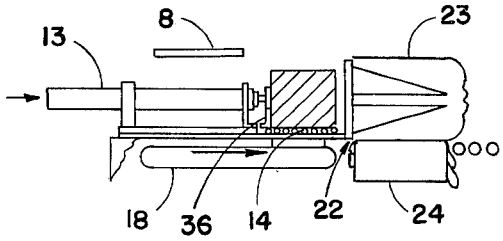
FIG. 6b
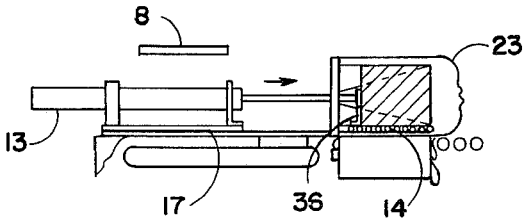
FIG. 6c
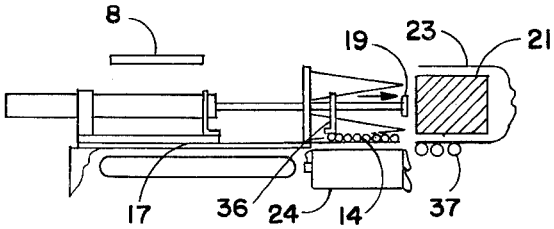
FIG. 6d
FIG. 6

APPARATUS AND METHOD FOR LOADING BLOCK-LIKE ARTICLES INTO A RECEPTACLE

FIELD OF THE INVENTION

This invention relates to a method and apparatus for automatically loading heavy, block-like articles into receptacles. The invention particularly relates to the loading of articles such as blocks of cheese weighing 40 pounds or more into flexible receptacles such as thermoplastic bags or pouches.

BACKGROUND OF THE INVENTION

It has recently been found that block cheese in sizes weighing 40 pounds or more may be both cured and shipped when vacuum packaged in thermoplastic bags having very low oxygen permeability. The block of cheese ages naturally in the protective environment, air is locked out, and moisture is locked in providing and promoting natural aging and natural flavor. The aging takes place without the instance of mold and the entire block is readily visible making inspection and quality control faster and more acurate. However, loading the heavy blocks of cheese into thermoplastic bags by hand is a cumbersome and time consuming process. In addition, when the job is done manually it is quite difficult to keep the bag mouth free of contact with the surface of the cheese. Since the surface of the cheese is greasy and oily, any contact with the bag mouth will deposit grease or oil in that area. Unfortunately, the bag mouth is the area where a heat seal must be made in order to hermetically seal the vacuumized bag. Any grease or oil will prevent adequate seals from being made so that leakage of air into the bag can occur. Thus, it is one object of the subject invention to provide a method of loading block-like articles into a bag without contacting the mouth of the bag with the article.

Another object of the subject invention is to provide a rapid and automatic method of packaging block-like articles which weigh 40 pounds or more into thermoplastic bags.

These and other objects are accomplished by the subject invention which will be better understood by reference to the Summary of Invention, Description of the Drawings, and the Description of the Preferred Embodiment which follow below.

SUMMARY OF INVENTION

In one aspect, the subject invention is an apparatus for loading a a block-like article into an opened receptacle comprising a reciprocally movable loading carriage means; means for positioning an article on said movable carriage means at one extreme of the carriage's reciprocal stroke; and, means mounted on the carriage for removing an article therefrom at the other end of the reciprocal stroke and for placing the article into an opened receptacle. The means for positioning an article on a movable carriage may be a pivotally mounted overhead means for pulling the article onto the carriage and the carriage may have mounted thereon spreader means for holding a bag open, movable conveyor bed means for delivering an article inside a receptacle; and, pusher means for pushing an article from the carriage into the opened bag.

In another aspect, the subject invention is a method of loading into an opened receptacle which comprises the steps of providing a reciprocally movable loading carriage positioning an article on said carriage; delivering said article into said receptacle while preventing the article from contacting the opening to the receptacle; and, further advancing said article into said receptacle and to the side of said receptacle opposite its opening.

DESCRIPTION OF THE DRAWINGS

In the drawings which are appended hereto and made a part of this disclosure,

FIG. 5 is a schematic representation of one phase of the operation of the preferred embodiment looking from the direction of lines 5—5 of FIG. 3 showing, in sequence, an article being brought to the end feed station of the preferred embodiment in FIG. 5*a;* the article being pulled onto the conveyor belt of the preferred embodiment in FIG. 5*b;* and, the article in position in FIG. 5*c* after being pulled onto the conveyor bed; and, FIG. 6 is a schematic representation of another phase of the operation of the preferred embodiment of the subject invention looking from lines 6—6 of FIG. 3 showing, in sequence, in FIG. 6*a* the article as it was placed in position on the conveyor bed of the carriage of the preferred embodiment in FIG. 5*c;* the carriage at the end of its stroke in FIG. 6*b;* the spreader, conveyor bed, and article being pushed into an opened receptacle in FIG. 6*c;* and, in FIG. 6*d* the article after it has been pushed to the back of the receptacle thereby dislodging the receptacle.

DESCRIPTION OF THE PREFERRED EMBODIMENT

Refering first to FIGS. 1 and 2, apparatus 1 which is the preferred embodiment of the subject invention will be described. The apparatus 1 is carried by base frame support 2 and upright frame member 3. Upright number 3 has an upper horizontal member as can be seen more clearly in FIG. 4 so that the entire cross section of member 3 somewhat resembles an inverted U with its sides bent inwardly.

Figure 3:
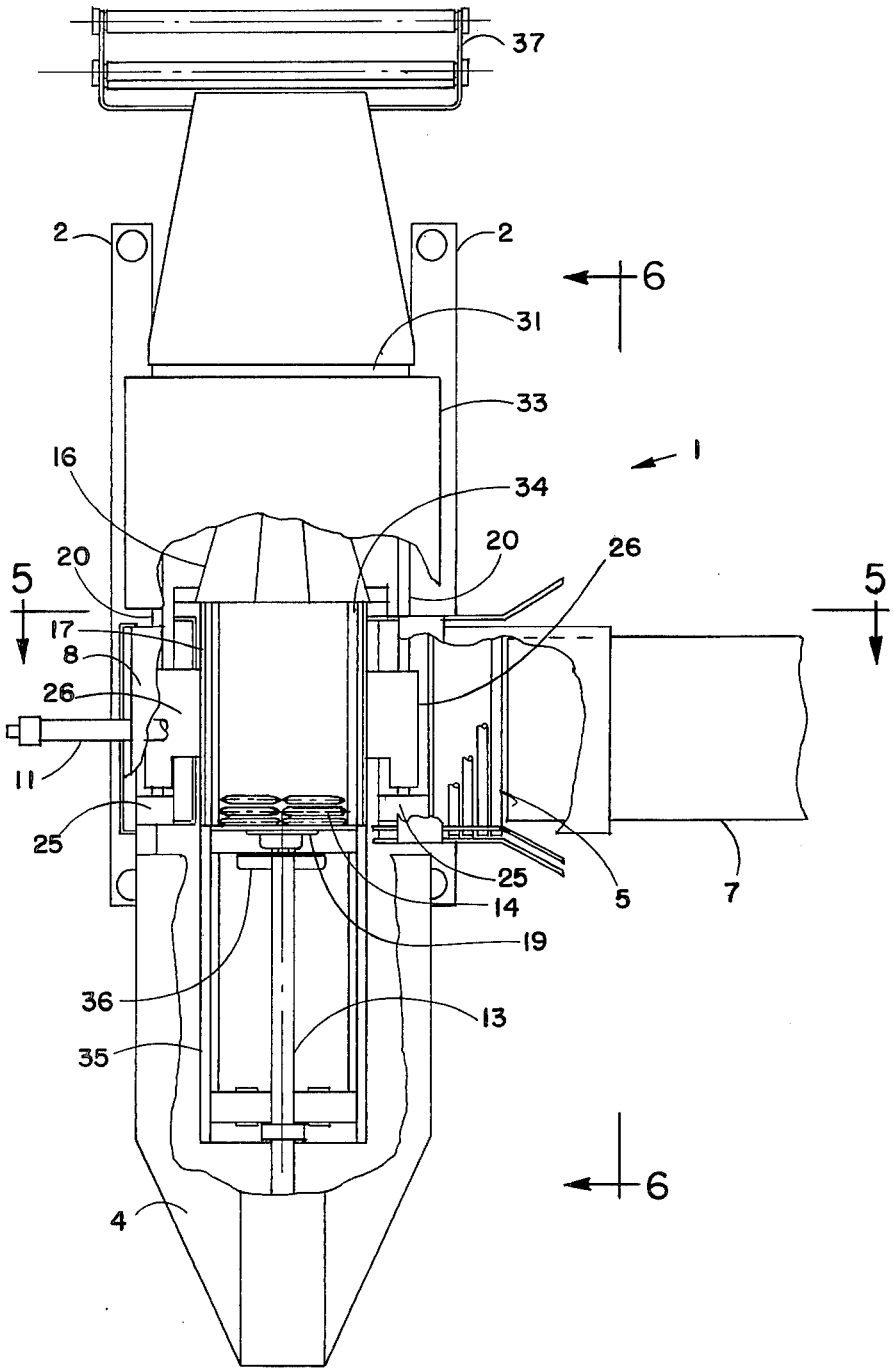
FIG. 3 is a top plan view of a preferred embodiment of the subject invention with the top cover partially broken away.
Figure 4:
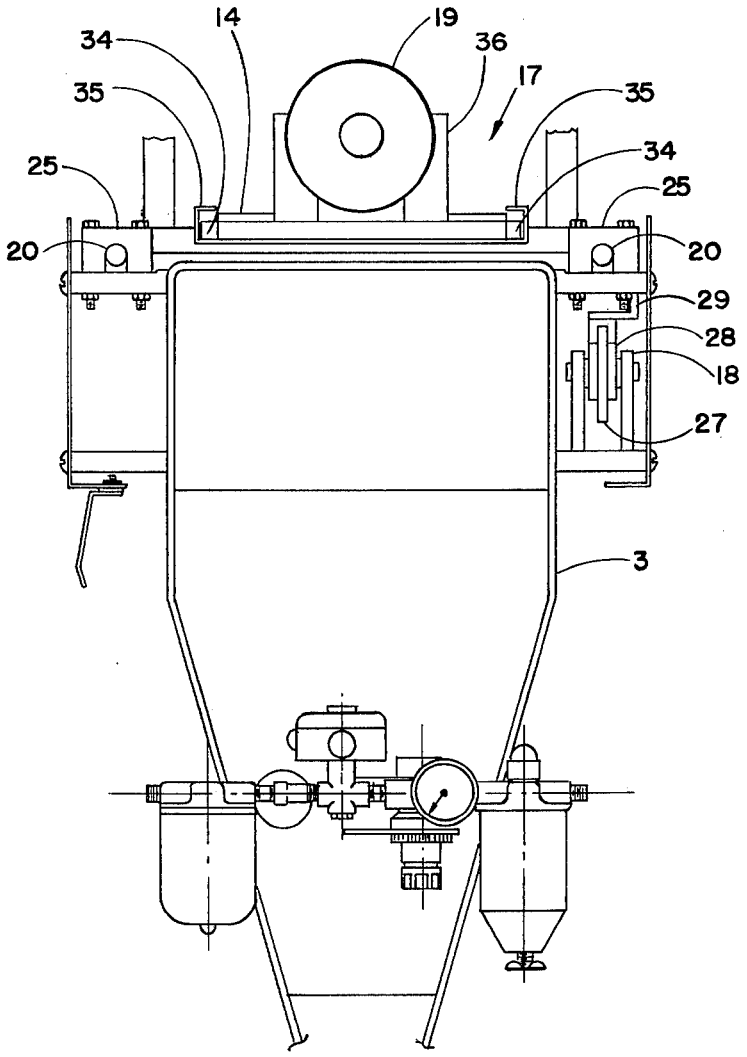
FIG. 4 is a partial front elevational view of the preferred embodiment of the subject invention looking in the direction of line 4—4 of FIG. 2.

Looking now at FIG. 4, shaft anchor block assemblies 25 are shown attached to both sides of the horizontal portion of the main upright frame support member 3. Held in these anchor blocks are shafts 20 upon which the reciprocally movable carriage means 17 slides. In FIG. 3 the top plan view of the loading carriage is shown with the cover 4 overhead frame 8, and safety shield 33 partially broken away; and, slide bearing blocks 26 can be seen with shafts 20 journaled therein. These bearing blocks 26 can not be seen in FIGS. 1 and 4 as they are behind the anchor blocks 25. The bearing blocks 25 support carriage 17 and allow it to move smoothly and freely backwards and forwards the length of the shaft in reciprocal motion. A cable drive is used to reciprocate the carriage 17 and the drive assembly 18 can be seen in FIG. 4. The end view of cable 27 as it passes around pulley 28 can be seen in FIG. 4 and the cable is attached to connecting member 29 which is fixed to the lower side of bearing block 26 which is not shown in the view. A pneumatic cylinder designated as the forth pneumatic cylinder also is now shown but is placed in the space below cable 27 and the reciprocal motion of this cylinder provides the driving force for the carriage.

Figure 1:
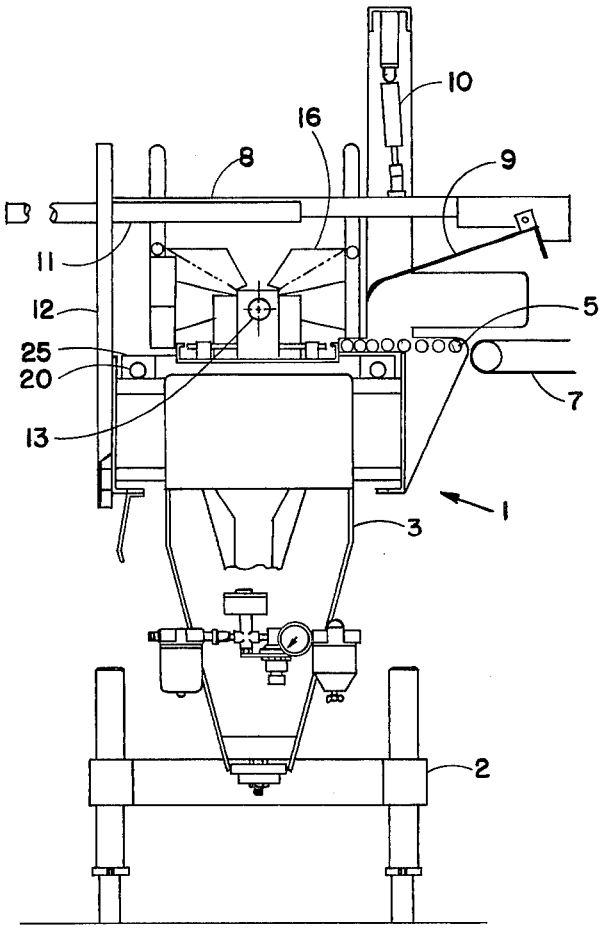
FIG. 1 is a rear elevation view of an apparatus which is a preferred embodiment of the subject invention.
Figure 2:
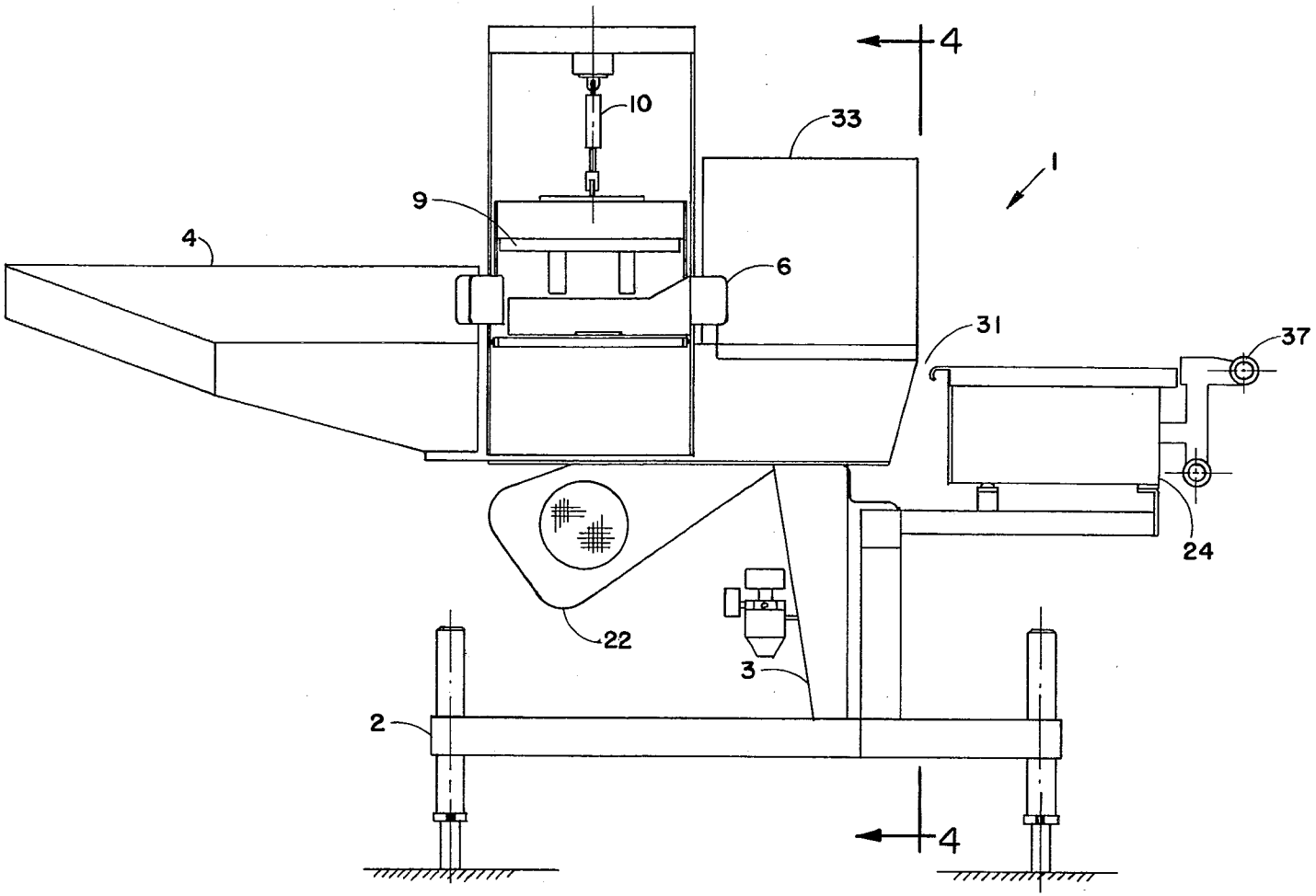
FIG. 2 is a side elevation view of a preferred embodiment of the subject invention.

Referring now to FIGS. 1, 3, and 4, third pneumatic cylinder 13 is shown mounted on the carriage 17 so that it moves therewith. The connecting rod or driving rod of the cylinder is attached to pusher plate or pad 19 which serves to push an article loaded onto the movable bead conveyor bed 14 of carriage 17 off of the carriage. Mounted at the other end of the carriage are spreader means 16 which are fixed to the carriage 17 but are pivotally mounted with return springs to swing outwardly so that after an article has passed through the spreader means the individual spreader arms will return to their original position where their forward ends are in close proximity allowing them to be inserted readily into the mouth of an open receptacle. As can be seen in FIG. 1, each of the four arms of the spreader means 16 is bent 45° and is preferably constructed of smooth, polished stainless steel so that the corners of a block-like article will slide smoothly therein. In fact, all corners of the block-like article are covered by the respective arms or spreader means 16 and the bottom of the article is supported by bead conveyor 14 when the article enters a receptacle so that the block-like article is shielded from touching the peripheral area around the mouth of the receptacle.

In addition to the spreader means 16 and the third pneumatic cylinder 13 which are fixedly mounted on carriage 17, bead conveyor 14 is slideably mounted on carriage 17. Looking at FIGS. 3 and 4 it is seen that the conveyor beads of bed 14 are supported by side rails 34 and the rails 34 slide within the outer frame portions of the carriage 17 which serve as guide tracks 35. The bed conveyor bed 14 is connected to the driving rod of cylinder 13 by connector plate 36. Thus, the entire loading assembly carriage 17 together with cylinder 13, spreader 16, and bead conveyor 14 can reciprocally move along the entire distance of shafts 20 being driven by cable drive 18; and, bead conveyor bed 14 can reciprocally move upon carriage 17 being driven by cylinder 13 so that when carriage 17 has been driven to the extreme of its stroke, cylinder 13 will drive bed 14 through the spreader 16 forcing the arms thereof apart and into the mouth of a waiting receptacle. When the bed 14 has reached the extreme of its travel and is held by end stops (not shown) on track 35, the pusher pad 19 which is spring loaded to move only when bed 14 has stopped will continue to move to discharge an article from the bed 14. In other words, the drive rod of cylinder 13 passes through connector plate 36 and has pusher plate 19 fixedly mounted on its end, but the drive rod has a spring loaded collar connection to plate 36 so that when the motion of bed 14 which is driven through the spring loaded collar and plate 36 is halted, then the pneumatic cylinder 13 overcomes the spring tension and its drive rod pushes pad 19 forward to move the article off bed 14.

Next, the pivotally mounted overhead means for advancing an article from the infeed station of the preferred embodiment to the loading carriage means will be described with particular reference to FIG. 1. In FIG. 1, conveyor 7 is seen which delivers a block-like article to be packaged guided by product guide 6 to roller conveyor bed 5 which serves as the infeed station for apparatus 1. As the conveyor belt 7 drives the block-like article across the roller conveyor 5 the article will strike the last roller in the bed to trigger the beginning of the loading action. As the article has traveled across the bed 5 its upper leading corner has contacted pivotally mounted puller plate 9 so that the longer portion of the puller plate has swung to a horizontal position thereby bringing the shorter portion of the puller plate into a vertical position immediately behind the upper trailing corner of the block-like article. Puller plate 9 is pivotally connected to the end of the drive rod from pneumatic cylinder 11 which is carried by overhead frame member 8 which also is pivotally mounted in cantilever fashion from upright support member 12. First pneumatic cylinder 10 is pivotally fixed to frame support member 30 and is connected by its drive rod to overhead frame member 8 to raise and lower same.

The means for supplying and opening the flexible receptacle is designated by numeral 24 in FIGS. 2 and 3 and, preferably, imbricated, taped bags are fed from below the level of the movable carriage 17 and are brought up in the space 31 between the loader 1 and the bag feeder 24. Blower 22 which can be seen in FIG. 2 supplies a constant stream of air to open each bag. Bag feeders and openers which may be suitably used with the subject invention are described in detail in U.S. Pat. No. 3,793,797 which issued on Feb. 26, 1974 to John T. Roberts et al and in U.S. Pat. No. 3,908,343 which issued on Sept. 30, 1975 to Walter M Farrelly. In the Roberts et al patent, for example, the shingled or imbricated bags are removably secured to a continuous adhesive tape and are brought up over the upper surface of a bag feeder assembly which is similar to the assembly 24 in FIG. 3 hereof and the bags are arranged so that the mouth of each bag faces towards the product to be loaded. The leading bag will be blown open by a jet of air similar to that supplied by blower 22 of FIG. 2 hereof. In addition to taped bags, bags on wickets can be used and such a wicketed bag arrangement is described in U.S. Pat. No. 3,770,134 which issued on Nov. 6, 1973 to Vytautas Kupzikevicius.

In addition to prior art patents mentioned above in regard to the bag feeder assembly, other prior art packaging devices which use spreader chutes and pusher means for loading packages are U.S. Pat. No. 2,685,996 which issued on Aug. 10, 1954 to W. M. Shoffner et al; U.S. Pat. No. 2,946,166 which issued on July 26, 1960 to T. R. Backster; U.S. Pat. No. 2,955,941 which issued on Oct. 11, 1960 to P. D. Hultkins et al; and, U.S. Pat. No. 3,052,075 which issued on Sept. 4, 1962 to R. L. Velasques.

Turning now to FIGS. 5 and 6 the operation of the preferred apparatus and the preferred method of the subject invention will be described. First, FIG. 5 is a schematic representation of the sequence of events that occur when the preferred apparatus is viewed from the direction of lines 5—5 of FIG. 3. In FIG. 5*a*, block-like article 21 is being brought to the infeed station represented by roller conveyor 5 by endless infeed conveyor 7. The leading edge of the product or article 21 is deposited on the set of rollers 5 thus pushing the pivotally mounted puller plate 9 into a horizontal position. At this point, the overhead frame 8 has been raised by the action of cylinder 10. As the article 21 travels across roller 5 a predetermined distance which corresponds to its length, it strikes triggering roller 32 which opens pneumatic switches that allow the overhead frame 8 to drop by gravity and which feed air to the drive end of second pneumatic cylinder 11 so that it will pull the article 21 from the position shown in FIG. 5*b* to the position shown in 5*c*. At this point, the product has been pulled onto the bead conveyor bed 14 of the loading carriage and the first pneumatic cylinder 10 will raise the overhead frame 8 and the second pneumatic cylinder 11 will return the puller plate 9 to its original position.

Looking now at FIG. 6 which is a view of sequential steps looking from line 6—6 of FIG. 3, the movement of article 21 from the last position shown in FIG. 5*c* will be described. In other words, the position in FIG. 5*c* and in FIG. 6*a* are the same except that the view is different. In FIG. 6*a* product 21 is shown on loading carriage 17 which is moved by the combination of the fourth pneumatic cylinder and an endless cable which is the carriage drive assembly 18. Also on carriage 17 is mounted third pneumatic cylinder 13 with pusher pad 19 connected to its driving rod. At the leading end of the movable carriage 17 are spreader means 16 which are in the collapsed position ready to enter the partially opened receptacle 23 which is held open by air from blower 22. The product in the position shown in FIG, 6*a* is resting on movable bed 14 and is held there for a short delay while the puller plate 9 shown in FIG. 5 is returned to its original position. At the moment that the puller plate 9 reaches the end of its stroke shown in FIG. 5*c* it strikes a switch mounted in the overhead frame 8 which, after a delay of the order of 1 to 2 seconds feeds air to the fourth pneumatic cylinder causing the loading carriage to move towards the opened bag 23. In FIG. 6*b* the loading carriage has moved to the end of its stroke and the spreader means 16 are inserted inside of bag 23. At the end of the stroke in FIG. 6*b* the carriage triggers another switch which actuates third pneumatic cylinder 13 which first pushes the bead conveyor bed 14 into the bag which now has its mouth spread open by the spreader means 16 as shown in FIG. 6*c*. The spreader means is opened primarily by the conveyor bed 14 and the article is conveyed into and past the sealing area of the bag mouth without touching same. In FIG. 6*d* the cylinder has completed its complete stroke driving the article 21 from bed 14 to the back of the bag 23 thereby dislodging the bag 23 from either the tape or wicket which holds it as the case may be. If the article being packaged is a block of cheese, for example, after the package has left the taped bag feeder assembly 24, it travels on exit conveyor 37 to a vacuumizing and sealing station where air is withdrawn from the bag and the mouth of the bag is heat sealed. Preferably the bag 23 is heat shrinkable and after the vacuumizing and heat sealing steps have been performed the package will pass quickly through a hot water bath so that the bag will shrink tightly around the cheese.

The switches and air control valves referred to hereinabove are familiar to those skilled in the art and are generally solenoid actuated valves. However, the pneumatic cylinders referred to could be replaced with electrical drives such as electrical motors and heavy duty solenoids and all the switching could be electrical; but, compressed air driven pneumatic cylinders are preferred for the subject apparatus.

Also, while the subject invention contemplates primarily the loading of block-like articles in the form of a cube or rectangular parallelopiped, an article of right-circular cylinder shape or other regular, symetric geometric shape could be loaded, the primary requirement being that the upper spreader arms are able to prevent the extremities of the article from touching the mouth of the bag. Thus, an article having upper edges which are separated by a major dimension of the article are preferred, e.g. a major dimension being the edge of a cube, a side of a rectangular parallelopiped, or the diameter of a right circular cylinder.

Having thus described our apparatus and method, we claim:

1. An apparatus for loading articles into an opened receptacle comprising:

a. reciprocally movable loading carriage means including a conveyor bed movable relative to said carriage;

b. means for positioning an article on said conveyor bed at one extreme of said carriage's reciprocal stroke; and, c. means mounted on said carriage for inserting said conveyor bed and an article into an opened receptacle and for removing the article therefrom at the other end of said reciprocal stroke thereby placing said article into an opened receptacle.

2. The apparatus of claim 1 wherein the means for positioning an article on said conveyor bed includes stationary pivotally mounted overhead means for pulling said article onto said carriage.

3. The apparatus of claim 1 including spreader means mounted on said movable carriage means to hold the mouth of a receptacle open.

4. The apparatus of claim 1 wherein said means mounted on said carriage for removing an article includes pneumatic cylinder means for pushing an article from said conveyor bed.

5. An apparatus for loading a block-like article into a flexible receptacle comprising:

a. an infeed station;

b. means for conveying said block-like article to said infeed station;

c. movable loading carriage means;

d. pivotally mounted overhead means for advancing said article from said infeed station to said loading carriage means which comprise:

i. a pivotally mounted frame member;

ii. a first pneumatic cylinder for raising and lowering said frame member;

iii. a second pneumatic cylinder mounted below said frame member;

iv. a puller plate pivotally attached to the end of the connecting rod of said second pneumatic cylinder;

v. first switch means associated with said puller plate, said means being responsive to the pivotal motion of said plate;

vi. roller means at said first station for receiving an article;

vii. second switch means responsive to an incoming article at said infeed station to actuate said first cylinder thereby lowering said frame so that when the puller plate contacts the article said first switch means actuates said second cylinder and pulls the article onto said loading carriage;

e. means for supplying and opening a flexible receptacle;

f. reciprocating means for moving said carriage means for a position adjacent said infeed station to a position adjacent said receptacle opening means and return;

g. spreader means mounted on said carriage means for holding the mouth of said receptacle open; and, h. pusher means mounted on said carriage means for pushing said article through said spreader means and into said receptacle.

6. The apparatus of claim 5 wherein said pusher means mounted on said carriage means comprises:

i. a third pneumatic cylinder; and, ii. a pusher pad at the end of the drive rod of said cylinder to push objects from said carriage and into an opened receptacle.

7. The apparatus of claim 5 wherein said movable loading carriage means comprises:

i. an upright base support member;

ii. a horizontal shaft anchored to said base member;

iii. a carriage slidably mounted on said shaft;

iv. a bead roller conveyor bed carried by said carriage for receiving said articles;

v. endless cable means attached to said carriage for moving said carriage in reciprocal motion; and, vi. fourth pneumatic cylinder means for driving said endless cable in reciprocating motion.

8. The apparatus of claim 5 wherein said movable loading carriage means includes a movable conveyor bed which is driven by the action of said third pneumatic cylinder.

9. A method of loading block-like articles into an opened receptacle comprising the steps of:

a. providing a movable loading carriage with spreader means and with conveyor bed means for receiving said article, said conveyor bed means being movable relative to said carriage;

b. applying a pulling force to the upper portion of a block-like article to pull same onto said conveyor bed;

c. at least partially opening a receptacle so that its mouth faces said article;

d. advancing said loading carriage to a position adjacent said opened receptacle;

e. spreading the mouth of said bag with said spreader means so that said article will not touch the mouth of said receptacle when placed therein; and, f. applying a pushing force to the side of said article opposite said receptacle to push said article and conveyor bed means into the receptacle.

10. The method of claim 9 wherein said block-like article weighs 40 pounds or more.

11. The method of claim 9 wherein said article is a block of cheese.

* * * * *

UNITED STATES PATENT OFFICE

CERTIFICATE OF CORRECTION

Patent No. 4,015,402 Dated April 5, 1977

Inventor(s) David K. Domnitz and Billy R. Osborne

It is certified that error appears in the above-identified patent and that said Letters Patent are hereby corrected as shown below:

Claim 5 (f), line 2: Delete the word "for" and insert in its place the word -- from --.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*